United States Patent [19]

O'Connor

[11] Patent Number: 4,621,777

[45] Date of Patent: Nov. 11, 1986

[54] PRE-FOLDED PACKAGED TAPE FOR ELECTRICAL CONDUCTORS

[76] Inventor: Lawrence O'Connor, P.O. Box 489, Lot 6, Clearwater Bay, Ontario, Canada

[21] Appl. No.: 679,117

[22] Filed: Dec. 6, 1984

[30] Foreign Application Priority Data

Dec. 13, 1983 [GB] United Kingdom ..... 8333176

[51] Int. Cl.[4] ..... B65H 18/28; B65H 35/02

[52] U.S. Cl. ..... 242/1; 156/185; 156/195; 156/201; 174/108; 242/56.4; 242/DIG. 2

[58] Field of Search ..... 242/DIG. 2, 56.4, 56.5, 242/56.1, 67.1 R, 67.2, 1, 55; 174/108, 109; 206/412; 156/53, 200, 201, 204, 185, 187, 188, 195

[56] References Cited

U.S. PATENT DOCUMENTS

| | | | |
|---|---|---|---|
| 2,135,668 | 11/1938 | Judelshon | 242/DIG. 2 X |
| 2,852,423 | 11/1958 | Bassett, Jr. | 174/109 X |
| 3,032,604 | 5/1962 | Timmons | 174/36 X |
| 4,268,714 | 5/1981 | Mori | 174/108 |
| 4,477,035 | 10/1984 | O'Connor | 242/67.1 R |

FOREIGN PATENT DOCUMENTS

| | | | |
|---|---|---|---|
| 176666 | 9/1961 | Sweden | 174/108 |

*Primary Examiner*—John M. Jillions
*Attorney, Agent, or Firm*—Stanley G. Ade

[57] ABSTRACT

A traversed package is formed from a tape which is slit from a laminate composed of a metallic foil layer and a dielectric insulating layer of plastic film, with a longitudinal edge or edges thereof folded back against the surface of the tape. The packaged tape can be applied to twisting conductors in a cabling process either helically or longitudinally with the folded edge or edges preventing the foil layer from electrical contact with adjacent conductors or shields.

2 Claims, 5 Drawing Figures

PRE-FOLDED PACKAGED TAPE FOR ELECTRICAL CONDUCTORS

This invention relates to packaged tape for use in the manufacture of electrical conductors.

In this specification the following terms are used to denote the following:

Spiral, or words derived therefrom, is defined as the plane curve generated by a point moving along a straight line while the line revolves about a fixed point.

Helix, or words derived therefrom, is the space curve generated by a point moving along a straight line while the line revolves about another line as an axis.

In the field of telecommunication and data transmission, particular care is required to ensure that adjacent sets or pairs of conductors are isolated from each other and that each pair of insulated conductors is also electrically shielded from its neighbors, in multiconductor cable assemblies. If this is not done, "crosstalk", or interference between adjacent pairs of conductors, may occur. Furthermore, the shielding of adjacent pairs, throughout the length of the cable, should be insulated so that no voltage can be developed which would cause signal interference if random contact occurred between adjacent shields throughout the cable. Grounding, or interconnection of shields, is required to be accomplished at designated points only, at the terminus of the cable, and may be combined with a drain wire which may be optionally included with each pair of conductors.

Each pair of conductors are helically twisted together during cable manufacture to minimize inductance, and this operation has been combined with several methods to apply a shield and insulating dielectric layer usually of aluminum foil and suitable plastic film respectively. Methods have included wrapping with a laminate of foil and dielectric film, which results in an exposed edge of foil which in turn requires over-wrapping with a layer of dielectric film to effectively isolate the exposed foil edge from the foil edge of adjacent conductor pairs.

This method requires two taping operations and two taping heads and is uneconomical because of the number of operations and the extra material involved.

Another method consists of a laminate having a foil inner layer and two outer dielectric insulating layers with the outermost layer being wider than the foil layer, known in the industry as "foil-free edge tape". When this is wrapped around the conductors the foil layer forms an inner core which is completely isolated from the outer film which covers both edges of the foil and therefore completely isolates it from contact with the shield of adjacent conductors.

Manufacture of this tape requires that the foil be laminated to a film of polyester or polypropylene in web width, to provide structural support to the foil for the slitting process, and in a subsequent step laminate this to a wider dielectric film. Again, added materials and manufacturing processes render this method costly.

In 1962 U.S. Pat. No. 3,032,604 assigned to the Belden Corporation, and now expired, disclosed a method of shielding and isolating a single conductor or pair of conductors by applying a laminate of foil and film with one edge folded back upon itself. This method required that the folding action take place immediately prior to the application of the tape, as a spiral pad commonly employed to package such tape is physically unstable if the fold is incorporated therein prior to application. In addition, spiral pads have a limited footage and require frequent stoppages of the machinery to position and splice new pads.

A further drawback of the above method is that while longitudinal continuity of the shield is assured, circumferential continuity is not, and in cases where high quality of transmission of digital signals is necessary, a foil-film laminate may have both edges folded back in Z-formation, the folded edges then forming a lap arrangement providing longitudinal and circumferential continuity of the foil shield and complete isolation of the conductors.

A further drawback of the above described method is the lack of uniformity in the fold or folds on the tape when such folding is done during the tape application process, as precision control is extremely difficult due to machine vibration and large masses of rotating machinery.

It is therefore the object of this invention to provide a more economical and pre-folded package of tape which is suitable for end use by any cable manufacturer on all conventional taping equipment, and including means for providing a stable package containing substantially longer lengths of tape than heretofore available, with a precisely defined fold or folds, of uniform quality and dimensions, which can be used to wrap conductors in the form as supplied in the package, and to provide a shielding conductive layer around the conductors which is in turn covered by an insulating layer isolating the conductive layer from contact with adjacent or outside conductors or shields.

According to the invention therefore there is provided a package of tape wherein the tape is slit from a laminate of a metallic foil layer and an insulating dielectric plastics layer and is folded such that one edge along the length thereof lies flat back against a surface of the tape, the package being formed from a plurality of wraps of said tape arranged such that the tape repeatedly traverses along the length of the package.

Such a tape has only two layers as opposed to the conventional three and is therefore more economical and yet incorporates the convenience and improved control of packaged tape.

According to a second aspect of the invention, therefore there is provided a method of winding a package of tape comprising forwarding a supply sheet formed of a metallic foil layer laminated to an insulating dielectric plastics layer, slitting the sheet into a plurality of tapes, folding each tape such that an edge along the length thereof is folded back flat over the surface of the tape, when simultaneously forwarding each tape to a separate winding position for winding onto a core, rotating the core and causing relative traversing movement of the core and winding position to wind the tape into a package.

As an example, the winding position is preferably held stationary relative to the axis of the core and the core is traversed back and forth relative to the winding position. Furthermore the folding of each tape can take place immediately downstream of the slitter. To control the tape downstream of the folding and to set in the fold, the tape is optionally passed around a roller with the fold on the outside. The tape is then held under constant tension between the forming station and a guide roller at the winding position means that there are no changes of tension or angle in the tape as it passes from the forming station to the guide roller at the winding position. Traversing movement is therefore taken up by movement of the core relative to the winding position.

As an example folding may take place at a folding shoe of suitable shape optionally followed by an idler roller around which the tape passes with the fold outermost. A second shoe can be placed immediately downstream of the roller to fold the other edge in the opposite direction with an optional second roller positioned again with the folded section at the other edge outermost.

It will be appreciated that the fold in the tape creates a double thickness edge to the tape which must be accommodated in the package. It has not therefore previously been possible to package pre-folded tape of this type in view of the difficulty caused by the double thickness folded edge causing instability in the conventional spiral pad.

The foil is preferably aluminum foil which depending upon requirements can have a thickness between 0.00025 inches and 0.002 inches.

The dielectric layer is preferably a polyester film and this can have a thickness in the range 0.00025 to 0.002 inches. In some cases polypropylene can be used as the dielectric layer. The foil and film are laminated into a sheet prior to the slitting and folding and generally as a separate process. Lamination can be carried out by any well known technique but preferably with an adhesive thus forming a sheet which may be up to 72 inches wide.

From the sheet tapes can be slit using a conventional series of razor blades or other knife type slitters arranged across the width lying in the range of 0.25 to 2.0 inches and typically of the order of 0.75 inches.

The width of the folded portion is the minimum which can be achieved and practically maintained bearing in mind the necessity to set the fold to form a crease line which maintains the folded portion back against the surface of the tape. In a practical example this folded portion can be of the order of 0.0625 inches in width.

In order to obtain a complete layer both of the film around the outside of the conductors and a complete shielding layer around said conductors the tape is folded such that the foil is on the innermost surface of the fold whereby the film fully encloses the edge of the foil to ensure that no portions of said edge are exposed when the tape is wrapped around the conductors and a continuous longitudinal shield is provided by the foil layer.

In an alternative method the other edge can be folded in the other direction, that is with the foil layer outermost again with a width of the order of 0.0625 inches, the fold taking place at a second folding station. Such a tape ensures the electrical continuity of the conductive aluminum foil layer around the conductors in the finished product and also ensures that each axial position of the conductors is completely surrounded by the conductive layer without any discontinuity.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
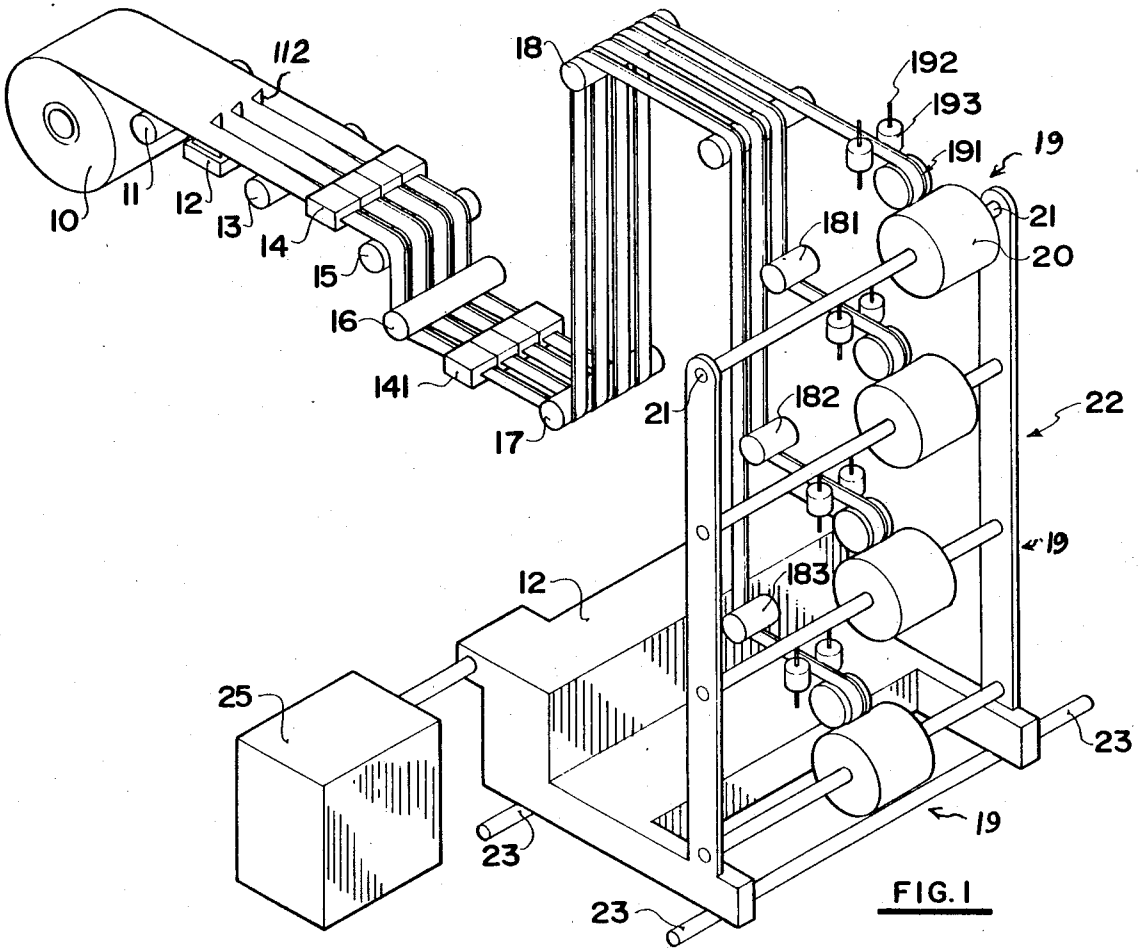
FIG. 1 is a schematic isometric view of an apparatus and method of forming and packaging tape including a winding station mounting a plurality of such packages.

Turning firstly to FIG. 1 there is shown a supply roll 10 of a laminated sheet having a layer of aluminum foil and a layer of a polyester insulating material.

The roll may be up to 72 inches wide. The sheet passes over an idler roller 11 to a slitting station 12, including a plurality of slitting knives 112 of conventional form where the sheet is slit into a number of separate tapes each of accurately controlled width. The separate tapes then pass to a second idler roller 13 so the tension and direction is accurately controlled through the slitting zone. The slit tapes then pass directly to a plurality of folding shoes 14 where each tape is folded so that one longitudinal edge is rolled back on itself to form a fold at the edge, following which the fold may optionally be further creased into position by rolling around the outside of an idler roller 15 to assist in permanently forming the fold into position.

Figure 2:
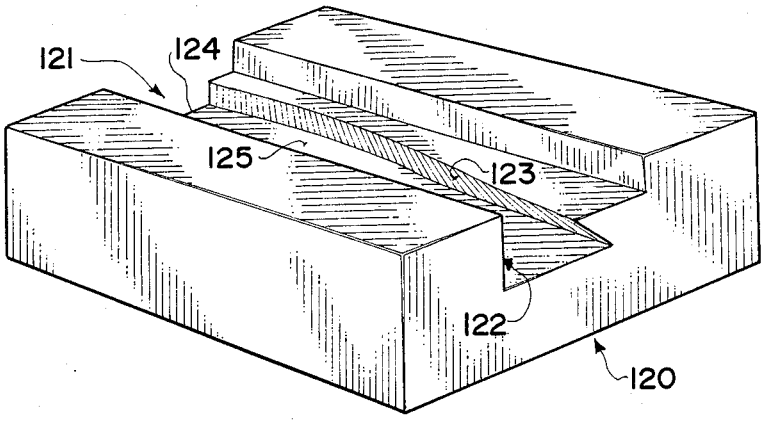
FIG. 2 is an isometric view of a folding shoe for use in the apparatus of FIG. 1.

One folding shoe is shown in FIG. 2 and comprises a metal block 120 with a tape guide track 121 milled in the upper face. The track 121 has one plane wall 122 and one shaped wall 123. The wall 123 is curved such that at the feed end 124 it is spaced form the wall 122 by the width of the tape. It then curves inwardly while remaining at right angles to the base 125 to lift one edge of the tape in view of a reduced spacing from the wall 122. Finally the wall 123 while remaining at the same spacing inclines toward the wall 122 to tend to fold the tape back on itself. The fold is optionally completed by the tension in the tape developed downstream of the folding shoe and optionally further creased by the increased tension in the folded back position as it passes at increased diameter around the idler roller 15.

The tape then passes around further idler rollers 16, 17, 18 to return to the original direction.

A second set of folding shoes 141 can be included downstream of the first after the roller 16 and before the roller 17 in order to fold the opposite edge of the tape in the opposite direction, the direction of the roller 17 being such that the newly folded portion lies preferably outermost.

Downstream of the roller 15 is positioned a number of winding stations each indicated at 19. Each winding station comprises a lay-on roller 191 and a guide shaft 192 mounting disks 193 to control the direction and movement of the tape. The shaft 192 and the roller 191 are mounted on a main frame of the apparatus which is omitted from the illustration for reasons of simplicity. Thus the tapes are separated at the roller 18 and at further redirecting rollers 181, 182, 183 to lead to the separate winding stations for separate winding on packages 20 at the winding station 19.

The packages 20 are separately mounted on shafts 21 mounted on a carriage generally indicated at 22. The carriage 22 is mounted on slide guides 23 for reciprocating movement in a tape traversing direction so the package is traversed relative to a winding position of the tape defined by the lay-on roller 191 and the guide 192. The device for traversing the package carriage 22 is indicated schematically at 25. Details of this device are described in U.S. Pat. No. 4,477,035. The device 25 therefore acts to traverse the carriage either to produce a traverse package in which the movement of the carriage is substantially reciprocating or alternatively a package in which the traverse is repeatedly held stationary at axially spaced positions along the length of the package for sufficient period of time to wrap the tape spirally of the package at that position following which the package is traversed to the next axially stationary position. In this way a package is built-up in a number of discreet steps. Further details of a package of this type are described in the above Canadian patent.

Figure 3:
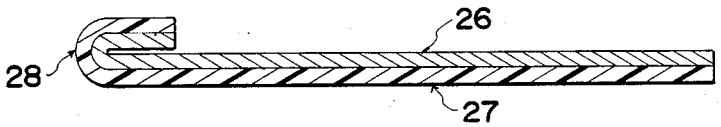
FIG. 3 is a schematic cross sectional view of a tape manufactured by the method of FIG. 1.

Turning now to FIG. 3, the foil layer is indicated at 26 and the polyester or the plastics insulation layer at 27. It should be noted that the longitudinal edge of the tape is folded back so that the polyester layer 27 fully encases one end of the tape indicated at 28.

Figure 4:
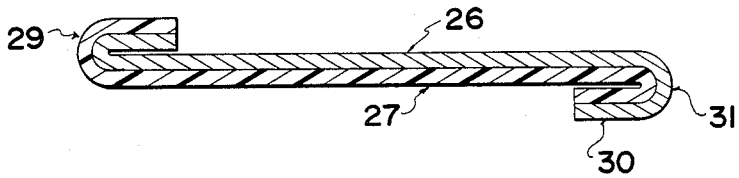
FIG. 4 is a similar view to that of FIG. 2 showing a modified tape.

FIG. 4 shows a tape similar to that shown in FIG. 3 where in addition the opposite longitudinal edge of the tape indicated at 30 is folded back in the opposite direction so as to lie flat against the opposite side of the tape covering the insulating layer 27. Thus, the right hand end of the tape indicated at 31 is fully encased in the aluminum conductive layer.

It is also possible for a package of the tape in "J" shape as shown in FIG. 3 to have the aluminum layer 26 outermost.

Figure 5:
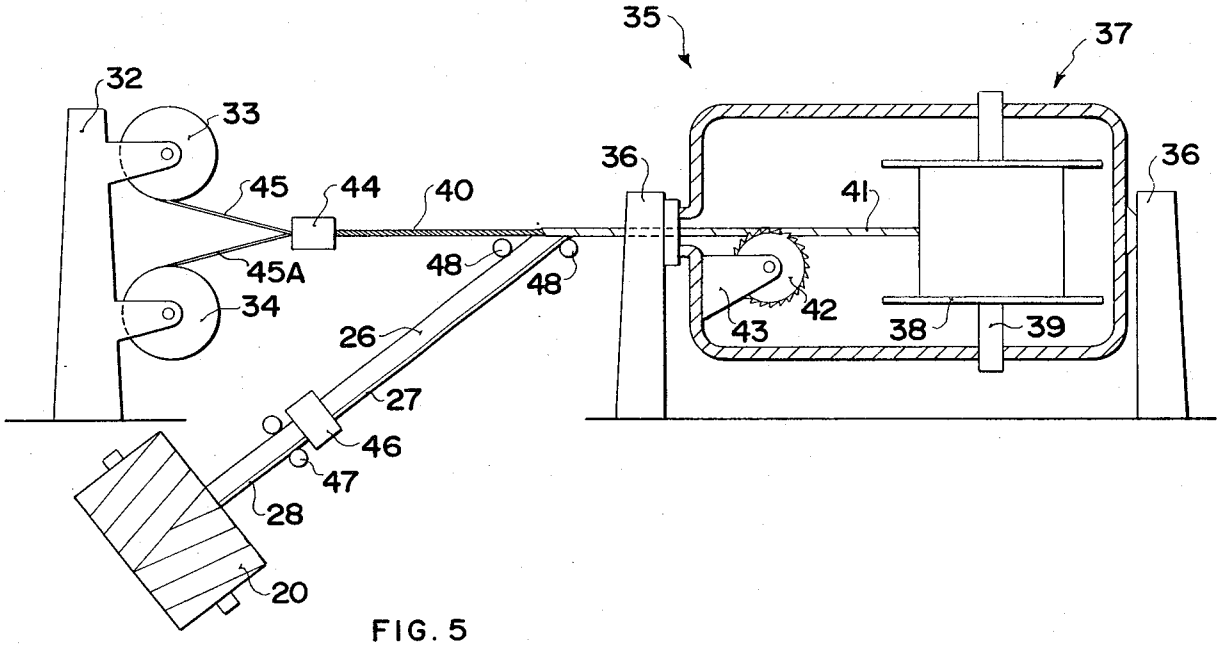
FIG. 5 is a schematic side elevational view of a cabling apparatus using the packaged tape of FIGS. 2 and 4.

Turning now to FIG. 5, there is shown a cabling machine for insulated conductors. The cabling machine comprises a let-off support stand indicated at 32 supporting a plurality of packaged conductors 33, 34 which are intended to be cabled into the finished product. The winding and twisting device generally indicated at 35 is one example of a device which can be used and comprises a support stand 36 which rotatably supports a winding and twisting device indicated at 37. The device 37 includes a take-up reel 38 mounted on a shaft 39 for rotation about the axis of the shaft 39 driven by an individual motor or drive gearing system which is omitted from the illustration for simplicity. The device 37 is also mounted for rotation about the axis of the cable indicated at 40 so that shaft 39 is also rotating about that axis while rotating about its own axis to provide wind-up of the finished cable indicated at 41. To control tension of the cable as it enters the twisting/winding device, a capstan 42 is provided mounted on a stand 43 carried by the device 37. The speed of rotation of the device 37 introduces a controlled amount of twist into the cable with the twist running back in the cabled conductors to a guide 44 which controls the entry of the individual conductors 45 and 45A from the packages 33 and 34 respectively.

During the cabling process as the twist in the conductors is running back from the device 37 to the guide 44, the tape as described in FIGS. 1 and 3 is drawn from the package 20 formed on the apparatus of FIG. 1 and wrapped around the twisting cable in a spiral manner dependent upon the speed of rotation or twisting of cable at the application point.

Thus the tape from the package 20 is passed through a pair of take-off rollers 46 via guides 47 with the aluminum layer 26 uppermost and the folded edge 28 on the right hand edge as shown exposing the insulating layer 27 along a narrow strip on the right hand side. The tape then passes through further guides 48 to wrap under the cable as it is twisting and is helically wrapped therearound with an overlap which is as small as possible while avoiding any possibility of a space between adjacent wraps. It is appreciated that the left hand edge of the tape is covered by the next adjacent wrap while the right hand edge is exposed and for this reason the right hand edge carries the fold 28 to ensure that there is no possibility of foil being exposed at any point along the length of the finished cable.

The angle of advance of the tape relative to the cable as controlled by the position of the rollers 46 relative to the guides 48 is controlled relative to the speed of take-up and speed of twisting of the cable and relative to the width of the tape to ensure that the helical wraps are properly applied at the required spacing and are obtained merely by the twisting of the conductors as the twist runs back to the guide 44.

The Z-fold illustrated in FIG. 4 can be used in some circumstances in the winding of cable as shown in FIG. 5. In this case, the fold 31, which presents the aluminum layer on the outer edge would be positioned on the left hand edge of the tape as it approaches the cable so that the folded portion 30 contacts the underside of the next adjacent layer to ensure continuity of the conductive layer.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A package of tape characterized in that the tape is slit from a laminate solely consisting of a metallic foil layer and an insulating dielectric plastics layer such that the tape comprises solely said foil layer and said dielectric layer with longitudinal edges thereof which are directly overlying, said tape being folded such that one edge along the length thereof lies flat back against a surface of the tape to form at said edge a portion of tape which is at least double the thickness of the laminate, the package being formed from a plurality of wraps of said tape arranged such that the tape repeatedly traverses along the length of the package.

2. A package according to claim 1 wherein the tape is folded such that the other edge along the length thereof lies flat back against the other surface of the tape.

* * * * *